US009791168B2

(12) United States Patent
Jansen et al.

(10) Patent No.: US 9,791,168 B2
(45) Date of Patent: Oct. 17, 2017

(54) HEATING BLOCK FOR HEATING WATER

(71) Applicant: Stiebel Eltron GmbH & Co. KG, Holzminden (DE)

(72) Inventors: Martin Jansen, Holzminden (DE); Wolfgang Heise, Holzminden (DE)

(73) Assignee: Stiebel Eltron GmbH & Co. KG, Holzminden (DE)

( * ) Notice: Subject to any disclaimer, the term of this patent is extended or adjusted under 35 U.S.C. 154(b) by 211 days.

(21) Appl. No.: 14/409,384

(22) PCT Filed: Jul. 3, 2013

(86) PCT No.: PCT/EP2013/001956

§ 371 (c)(1),
(2) Date: Dec. 18, 2014

(87) PCT Pub. No.: WO2014/005708

PCT Pub. Date: Jan. 9, 2014

(65) Prior Publication Data

US 2015/0323219 A1 Nov. 12, 2015

(30) Foreign Application Priority Data

Jul. 6, 2012 (DE) ..... 10 2012 013 346

(51) Int. Cl.
*F24H 1/10* (2006.01)
*H05B 3/78* (2006.01)
(Continued)

(52) U.S. Cl.
CPC ..... *F24H 1/103* (2013.01); *F24H 9/2028* (2013.01); *H05B 1/0202* (2013.01); *H05B 1/0244* (2013.01)

(58) Field of Classification Search
None
See application file for complete search history.

(56) References Cited

U.S. PATENT DOCUMENTS 1,043,922 A * 11/1912 Gold ..... F24H 3/004 165/104.27
3,088,017 A * 4/1963 Schomann ..... F24H 1/103 392/493

(Continued)

FOREIGN PATENT DOCUMENTS

CN 2010-00188 1/2008
DE 11 12 621 8/1961

(Continued)

OTHER PUBLICATIONS

International Search Report for Application No. PCT/EP2013/001956 dated Nov. 15, 2013.

(Continued)

*Primary Examiner* — Thor Campbell
(74) *Attorney, Agent, or Firm* — Haug Partners LLP

(57) ABSTRACT

A heating block including a heating block body which receives/guides a liquid medium, an electric heating element arranged in the cavity for heating the medium via electric current, a semiconductor switch for controlling the electric current flowing through the heating element to control a heating power of the heating element, and a closure piece for closing an opening in the heating block body to the cavity element. The semiconductor switch is electrically and thermally conductively connected to the closure piece via first connection terminal to electrically connect the first connection terminal to the heating element via the closure piece, and to thermally connect the first connection terminal to the medium via the closure piece. The semiconductor switch is directly connected to a control board by a second connection terminal so that the semiconductor switch is spatially arranged and mechanically connected directly between the control board and the connection piece.

10 Claims, 2 Drawing Sheets

(51) Int. Cl.
*F24H 9/20* (2006.01)
*H05B 1/02* (2006.01)

(56) References Cited

U.S. PATENT DOCUMENTS 3,621,566 A * 11/1971 Welsh ..... F24H 1/202 29/610.1
4,224,503 A 9/1980 Gijzel et al.
4,567,350 A * 1/1986 Todd Jr. ..... F24H 9/2028 219/213
4,687,905 A * 8/1987 Cunningham ..... H05B 3/82 219/517
4,762,980 A * 8/1988 Insley ..... F24H 1/103 338/305
4,900,896 A * 2/1990 Maus ..... F24H 9/2028 200/81.9 M
5,020,127 A * 5/1991 Eddas ..... F24H 9/2028 219/486
5,325,822 A * 7/1994 Fernandez ..... F24H 9/2028 122/448.3
5,408,578 A * 4/1995 Bolivar ..... F24H 1/102 219/481
5,440,667 A * 8/1995 Simpson ..... F24H 1/106 219/509
5,586,214 A * 12/1996 Eckman ..... H05B 3/04 219/523
6,080,971 A * 6/2000 Seitz ..... F24H 9/2028 219/483
6,240,250 B1 * 5/2001 Blanco, Jr. ..... F24H 1/102 392/474
7,779,790 B2 * 8/2010 Fabrizio ..... F24H 1/102 122/4 A
8,165,461 B2 * 4/2012 Sullivan ..... F24H 1/142 392/465
8,280,236 B2 * 10/2012 Fabrizio ..... F24H 1/103 392/485
8,577,211 B2 * 11/2013 Lucker ..... F24H 1/142 392/470
9,167,630 B2 * 10/2015 Seitz ..... F24H 1/202
2008/0285964 A1 11/2008 Sullivan
2011/0013893 A1 * 1/2011 Fabrizio ..... F24H 1/103 392/465
2012/0057857 A1 * 3/2012 Kenney ..... F24H 1/142 392/465
2012/0063755 A1 * 3/2012 Lucker ..... F24H 9/2028 392/470

FOREIGN PATENT DOCUMENTS

| | | |
|---|---|---|
| DE | 22 15 260 | 11/1973 |
| DE | 24 00 478 | 7/1975 |
| DE | 38 15 687 | 11/1989 |
| DE | 41 06 273 | 5/1992 |
| DE | 102 09 905 | 9/2003 |
| EP | 2 445 680 | 5/2012 |
| JP | S53-78462 | 11/1978 |
| KR | 10-2010-0036181 | 4/2010 |
| WO | WO 93/19332 | 9/1993 |

OTHER PUBLICATIONS

German Search Report for Application No. 10 2012 013 346.4 dated Feb. 20, 2013.
Third Chinese Office Action for Application No. 201380036114.5 dated Mar. 6, 2017.
Frist Chinese Office Action for Application No. 201380036114.5 dated Aug. 2, 2016.
Second Chinese Office Action for Application No. 201380036114.5 dated Dec. 2, 2016.
German Search Report for Application No. DE 10 2016 002 942.0 dated Mar. 6, 2017.
English Translation of the Written Opinion of the International Search Authority (PCT/EP2013/001956) dated Jan. 6, 2015.

* cited by examiner

HEATING BLOCK FOR HEATING WATER

The present application claims priority from PCT Patent Application No. PCT/EP2013/001956 filed on Jul. 3, 2013, which claims priority from German Patent Application No. DE 10 2012 013 346.4 filed on Jul. 6, 2012, the disclosures of which are incorporated herein by reference in their entirety.

1. Field of the Invention

The present invention is directed to a heating block for heating a liquid medium, particularly for heating water. The present invention is further directed to a continuous-flow heater with a heating block.

It is noted that citation or identification of any document in this application is not an admission that such document is available as prior art to the present invention.

A heating block for heating water such as is used, for example, in an electric continuous-flow heater, is well known. A heating block of this type is basically constructed to guide water to be heated into a cavity such as meanderingly arranged heating conduits. Heating wires carrying electric current for heating the water are arranged in these heating conduits and therefore, as intended, in the water. This electric current can be controlled, e.g., by a semiconductor switch such as a triac. Correspondingly, the triac is to be electrically connected to the heating wire so that the current can flow from the triac to the heating wire. Further, the triac must be supplied in turn with electric current and also triggered correspondingly in order to control the electric current through the heating wire as needed.

In this regard, the connection and triggering of the semiconductor switch is particularly problematic. On the one hand, a control switch is provided on a corresponding control board, possibly with a microprocessor. The control, per se, requires relatively small currents and voltages. On the other hand, the semiconductor switch generates high currents which are fed into the heating wire and, in bare wire systems, make direct contact with the water to be heated. The semiconductor switch must form a kind of link therebetween and take into account the very different conditions with respect to connecting and controlling. In addition, the high current which leads to a required heating in the heating wire heats the semiconductor switch in an unwanted manner. The semiconductor switch must be cooled in a corresponding manner as the case may be.

It has already been suggested for this purpose in German Patent Application DE 102 09 905 A1 to arrange the semiconductor switch directly on a closure piece instead of on a board, this closure piece in turn being in direct contact with the water to be heated. In this way, the semiconductor switch is cooled by the water via the closure piece. This step which suggests relocating the semiconductor switch from a board to the closure piece is also intended to reduce the cost of contacting for the semiconductor switch and therefore for the device as a whole.

However, it is still expensive to connect semiconductor switches even with a solution of this type.

It is noted that in this disclosure and particularly in the claims and/or paragraphs, terms such as "comprises", "comprised", "comprising" and the like can have the meaning attributed to it in U.S. patent law; e.g., they can mean "includes", "included", "including", and the like; and that terms such as "consisting essentially of" and "consists essentially of" have the meaning ascribed to them in U.S. patent law, e.g., they allow for elements not explicitly recited, but exclude elements that are found in the prior art or that affect a basic or novel characteristic of the invention.

It is further noted that the invention does not intend to encompass within the scope of the invention any previously disclosed product, process of making the product or method of using the product, which meets the written description and enablement requirements of the USPTO (35 U.S.C. 112), such that applicant(s) reserve the right to disclaim, and hereby disclose a disclaimer of, any previously described product, method of making the product, or process of using the product.

SUMMARY OF THE INVENTION

Therefore, it is the object of the present invention to address at least one of the problems mentioned above. In particular, a heating block is to be improved in such a way that a semiconductor switch for controlling a heating current can be installed and connected in the simplest possible manner and as permanently as possible. At the least, an alternative solution is to be found.

A heating block of this kind is provided for heating a liquid medium, particularly water. It comprises a heating block with a cavity for receiving or guiding the medium. In particular, a heating block of this type is intended for a continuous-flow heater and, in this case, the heating block body guides the medium, namely particularly water, while it is heated. However, fundamentally different variants can also be considered in which a liquid medium such as, e.g., water is heated in a reservoir or the like.

At least one electric heating element for heating the medium is arranged in the cavity. The electric heating element is energized for this purpose by an electric current which results in heating of the heating element. A heating element of this kind is formed particularly as a heating wire, particularly as a so-called bare heating wire, in direct galvanic contact with the liquid medium, namely particularly water.

Further, a semiconductor switch is provided, particularly a triac. The current which is to flow through the heating element is controlled by this semiconductor switch in order thereby to control the heating power of the heating element. Usually, this semiconductor switch provides the current in a pulsed manner. The average amount of current or current strength can possibly be influenced by changing the pulse pattern. Of course, the semiconductor switch can also switch off the current completely when heating is not to be carried out.

Further, a closure piece is provided for closing an opening in the heating block body to the cavity. An opening of this kind accordingly forms an access to the cavity, and the heating element can also be inserted into the cavity through this opening. If a plurality of heating elements are provided, a corresponding quantity of openings and closure pieces can also be provided.

The semiconductor switch is electrically and thermally conductively connected to the closure piece by a first connection terminal such that an electrical connection of the first connection terminal to the heating element is carried out via the closure piece and a thermal connection of the first connection terminal to the medium is carried out via the closure piece.

Further, the semiconductor switch is directly connected to a control board by a second connection terminal so that the semiconductor switch is also spatially arranged and mechanically connected directly between the control board and the connection piece.

Accordingly, on the one hand, the semiconductor switch sits on the closure piece so that an electric and thermal connection can be directly produced basically without supplementary elements. Further, the semiconductor switch sits directly on the printed circuit board so that additional connection lines, particularly connection wires or connection slots, between the printed circuit board and semiconductor switch can also be dispensed with at that location. Accordingly, in particular, a heating block is suggested in which these elements, namely particularly the printed circuit board, the semiconductor switch, the closure piece and preferably also the heating block body, can be adapted to one another for this purpose. This not only simplifies the connection possibility, but the elements are also thermally coupled to one another and closely cooperate to this extent. The board and/or heating block body can be adapted to one another for this purpose.

The control board is preferably mechanically connected to the closure piece via the semiconductor switch, particularly such that the three elements, i.e., the control board, semiconductor switch and closure piece, form an assembled total component part. For example, the semiconductor switch can be fixedly connected to the board inter alia by soldering. Further, the semiconductor switch can be fixedly connected to the closure piece inter alia by screwing. Preferably, a galvanic connection takes place by carrying out a mechanical connection. For example, the semiconductor switch with the first connection terminal is fixedly screwed to the closure piece in a conductive location such that a galvanic connection is produced between the first connection terminal and the closure piece.

It is advantageous when the control board, or at least a portion of the control board, is connected to the closure piece and the semiconductor switch arranged between these two elements such that a sandwich structure results in which the semiconductor switch correspondingly forms a middle layer, or the middle layer, of this sandwich structure. This results in a snug connection of the control board, semiconductor switch and closure piece which is advantageous in mechanical, electrical and thermal respects. The semiconductor switch can be supplied via the control board with the required energy, namely with the required supply current, and it can be triggered via the control board by control signals, namely switching signals. In this case, there is no need for a conducting wire, cord or the like for either the supply current or the control signals for connecting the semiconductor switch.

At the same time, the semiconductor switch is wirelessly connected to the closure piece and, via the latter, to the heating element. Correspondingly, no cable, line, cord or the like is required either on the input side or output side for connecting the semiconductor switch.

The closure piece is preferably in electrical contact with the medium insofar as this liquid medium flows through or fills the hollow body as is intended. Accordingly, there is a galvanic connection between the closure body and the liquid medium, particularly water, and therefore, as a result, there is also a galvanic connection between the first connection terminal of the semiconductor switch and the liquid medium. The heating block, particularly the semiconductor switch, is correspondingly configured for this type of use with a direct galvanic contact with the liquid medium to be heated. Correspondingly, electric insulation paths are also provided in the heating block. For this purpose, the heating block body is preferably fashioned from a nonconductive material, e.g., nonconductive plastic, in other respects, that is, with the exception of the closure piece or the plurality of closure pieces and further possible minor exceptions. In case of a continuous-flow heater, portions of insulation ducts can be provided which can achieve sufficient insulation along corresponding sections of conduit, also through the water.

A high thermal conductivity is also achieved by means of this direct electrical contact. In every case, there is a close relationship between electrical conductivity and thermal conductivity in many metal conductors.

According to an embodiment, it is suggested that the heating block is characterized in that a heating coil fastening pin is provided for the electrical connection of the semiconductor switch to the heating element, wherein the heating coil fastening pin is provided for producing a thermal connection between the semiconductor switch and the medium so that the semiconductor switch is cooled through the medium via the heating coil fastening pin.

Accordingly, in particular, a heating coil fastening pin extends into the medium or into the cavity. A bore hole, for example, to which the heating element, e.g., in the form of a heating wire, is mechanically, electrically and partially also thermally connected may be provided in this area of the heating coil fastening pin extending into the medium or cavity. Further, the heating coil fastening pin has a corresponding contact surface by which it comes in contact with the liquid medium. Aside from a galvanic connection to the medium via this contact surface, the latter also realized a thermal connection. The farther the pin projects into the medium and the larger the surface of this pin in this region, the better the emission of heat from the heating coil fastening pin to the medium. In this way, by means of the direct connection of the semiconductor switch to the connection piece and, therefore, to the heating coil fastening pin, heat from the semiconductor switch can be given off via the closure piece and further via the heating coil fastening pin into the medium.

It is advantageous to provide the heating coil fastening pin in such a way that it is integrated in the closure piece, particularly in such a way that the heating coil fastening pin forms an individual element of one piece, particularly a metal piece, with the closure piece or with the rest of the closure piece, except for a seal, usually made of rubber, insofar as this seal is part of the closure piece and not part of the opening of the heating block body. Accordingly, the closure piece can be formed in a simple manner with heating coil fastening pins and, therefore, overall with a connection possibility for the heating element. An additional electrical connection of the heating coil fastening pin and closure piece is accordingly dispensed with and any possible problems with bad connections are therefore obviated.

Further or alternatively, it may be advantageous that the heating coil fastening pin has connection means at its side facing the medium for electrical connection of the heating element. Connection means of this type can be a bore hole in a simple case.

Further or alternatively, it is advantageous when the heating coil fastening pin and/or the closure piece has at a side remote of the medium a receptacle for receiving fastening means for fastening the semiconductor switch to it. These fastening means can be, for example, a threaded bore hole into which a screw is screwed for fastening the semiconductor switch, particularly for screwing down a first connection terminal of the semiconductor switch. For this purpose an embodiment of a heating coil fastening pin can be used in which the heating coil fastening pin projects into the medium or into the hollow body and in so doing has an outer diameter that is greater than the screw such that the screw can be screwed into this heating coil fastening pin from the inner side. Accordingly, the length of the screw can be greater than the thickness of the closure piece so as to prevent excessively high thermal resistance of the closure piece and, therefore, inadequate cooling of the semiconductor switch via the closure piece toward the medium.

The closure piece is preferably provided for inserting into the opening of the heating block body from the inner side proceeding from the cavity of the heating block body. To this end, the closure piece has an outer rim by which it can be fitted to or placed at the corresponding opening from the inner side. This outer rim is accordingly placed against a corresponding circumferential rim of the opening, namely, proceeding from the side of the cavity. Also, the outer rim is accordingly provided as circumferential rim. Accordingly, its outer circumference exceeds a circumference of the opening and, in case of a circular shape of closure piece and opening, the outer diameter of this circumferential outer rim is correspondingly greater than the inner diameter of the opening. The closure piece is accordingly inserted into the opening from the inner side and its outer rim lies on a corresponding wall in which the opening is formed. During operation of the heating block, i.e., when a liquid medium such as water flows through the heating block, the closure piece can be pressed even farther into the opening by a corresponding overpressure in the heating block body and in so doing possibly further improves the sealing, particularly can lead to a re-sealing.

The semiconductor switch, namely particularly the triac, can be fastened to the closure piece after the latter has been inserted into the opening. In particular, the closure piece can be inserted into a shell or partial shell of the heating block body from the inner side in such a way that the heating block body can then be composed of this shell or partial shell and a further shell or further partial shells so as also to form the cavity in its entirety. In particular, the shells or partial shells can be welded. Subsequently, when the heating block body is finished to this extent, the semiconductor switch, particularly the triac, can be fastened, particularly by screwing, from the outer side. Accordingly, an advantageous solution is found particularly for the use of a triac in which the closure piece is inserted into the opening from the inner side and the triac can be fastened subsequently.

Accordingly, as has been described, it is advantageous when the heating coil fastening pin and the closure piece are substantially formed as a one-piece metal body. It is likewise advantageous when the receptacle for receiving fastening means is formed as a blind hole with internal thread in order to screw in fastening means with external thread, particularly a metal screw.

The invention and the above-mentioned embodiment forms have been described substantially with reference to a heating element and a closure piece and correspondingly a semiconductor switch. In an advantageous manner, a plurality of heating elements, for example, three heating elements, and correspondingly three closure pieces and correspondingly three semiconductor switches are provided.

In this case, the semiconductor switches can be accommodated on a control board, or all three—or two or more than three—semiconductor switches can advantageously be accommodated on an individual control board. Particularly in this case, the control board is adapted to the shape and configuration of the heating block body so that semiconductor switches which are correctly installed on the control board are seated directly at the required place in their respective closure piece when the control board is mounted on the heating block body. A connection to the respective closure piece can then be carried out, for example, simply via a mechanical connection, particularly simply by screwing to the closure piece by means of a screw.

In case three heating elements are used, they can be actuated in the manner of a 3-phase system and wired via a common star point. In the example in which a heating wire is used as heating element, this heating wire is accordingly electrically connected with one side at the star point and with the other side at the semiconductor switch.

The heating block is advantageously used in a continuous-flow heater according to one of the embodiment forms.

Further, a heating apparatus according to claim 9 is suggested, namely a heating apparatus such as one of the heating blocks which are described or claimed, only without heating block bodies.

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

Figure 1:
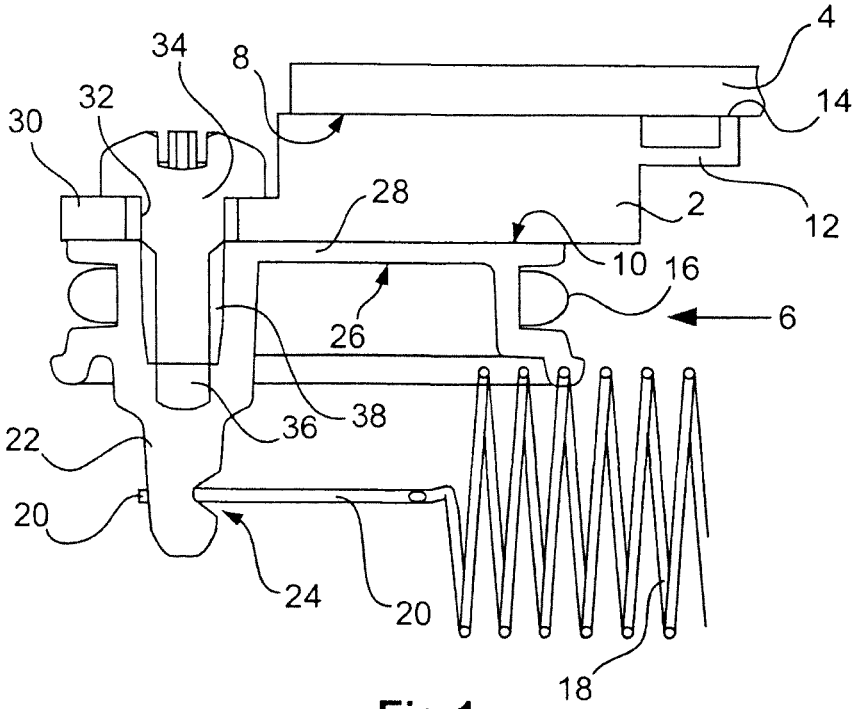
FIG. 1 shows a semiconductor switch between a board and a closure piece and part of a heating element schematically in a side sectional view.

FIG. 1 shows a sandwich structure in which a semiconductor switch 2 is arranged between a control board 4 and a closure piece 6. The semiconductor switch 2 lies flat against an upper contact surface 8 at the control board 4. The semiconductor switch 2 lies flat against a lower contact surface 10 at the closure piece 6.

The control board 4 can accordingly provide the semiconductor switch 2 fastened thereto. For purposes of contacting, the semiconductor switch 2 has a plurality of connections 12, namely three connections 12, only one of which is shown because of the side view. A possible contacting of the connections 12 is shown schematically in FIG. 1, and the connections 12 accordingly pass at an angle directly into a board connection area 14 on the control board 4. The connection can also be carried out differently; a direct contacting of the connections 12 on the control board 4 is advantageous. Only a detail of the control board 4 is shown in FIG. 1.

The closure piece 6 has a sealing ring 16. Therefore, the closure piece 6 can be sealingly inserted into an opening. In so doing, the portions shown above the sealing ring 16, particularly the lower contact surface 10 and, along with it, the semiconductor switch 2, are outside of the heating block body into whose opening the closure piece 16 is inserted from the inner side, the closure piece 6 being inserted into the opening outward from the heating block body. An outer rim 50 is provided by which the closure piece 16 contacts a rim of the opening of the heating block body from the inner side. The rest of the elements are positioned substantially facing toward the cavity of the heating block body. In particular, the heating element 18 which is formed as heating wire and which is shown only partially and only schematically is located as intended in the medium to be heated, particularly in the water to be heated. The heating element 18 is fastened to and electrically connected with a connection wire portion 20 in a heating coil fastening pin 22. The fastening is carried out in connection means 24 which are formed approximately like a bore hole 24.

The above-mentioned heating coil fastening pin 22 is actually a portion of the closure piece 6. This heating coil fastening pin 22 projects far into the medium in every case when used as intended. In this respect, the liquid medium also extends up to an inner surface 26 of the closure piece 6 which is basically provided adjacent to the lower contact surface 10. Accordingly, there is merely a relatively thin cover layer 28 between the lower contact surface 10 and the inner surface 26. Accordingly, heat from the semiconductor switch 2 can be given off via the cover layer 18 over a fundamentally large surface area to the liquid medium to be heated, particularly water. The lower contact surface 10 between semiconductor switch 2 and closure piece 6 and the inner surface 26 between cover layer 28 and liquid medium offer only a low thermal resistance insofar as this is noteworthy at all.

A fastening of the semiconductor switch 2 is carried out via a fastening tab 30 having a fastening opening 32. A fastening screw 34 is snugly guided through the fastening opening 32 and screwed into a blind hole 36 having internal thread 38. The blind hole 36 reaches far into the heating coil fastening pin 22. In this way, a stronger and more secure connection can be produced between semiconductor switch 2 and closure piece 6. An electric heating current for heating the heating element 18 can also flow via this connection. To this extent, the fastening tab 30 also forms a first connection terminal 30 of the semiconductor switch 2.

Further the fixed mechanical connection by means of the fastening screw 34 which also produces an electrical connection is suitable for transmitting heat. Accordingly, heat can flow additionally to the indicated path directly via the cover layer 28 and also via the heating coil fastening pin 22 into the medium which is to be heated.

FIG. 1 shows a sandwich-type structure of—from top to bottom—control board 4, semiconductor switch 2 and closure piece 6. This sandwich-type structure allows a simple connection of the semiconductor switch to the heating element 18 as well as to the control board 4. The entire construction which is achieved is relatively simple and in particular is formed directly and prevents unnecessary connection elements, particularly unnecessary wiring.

Figure 2:
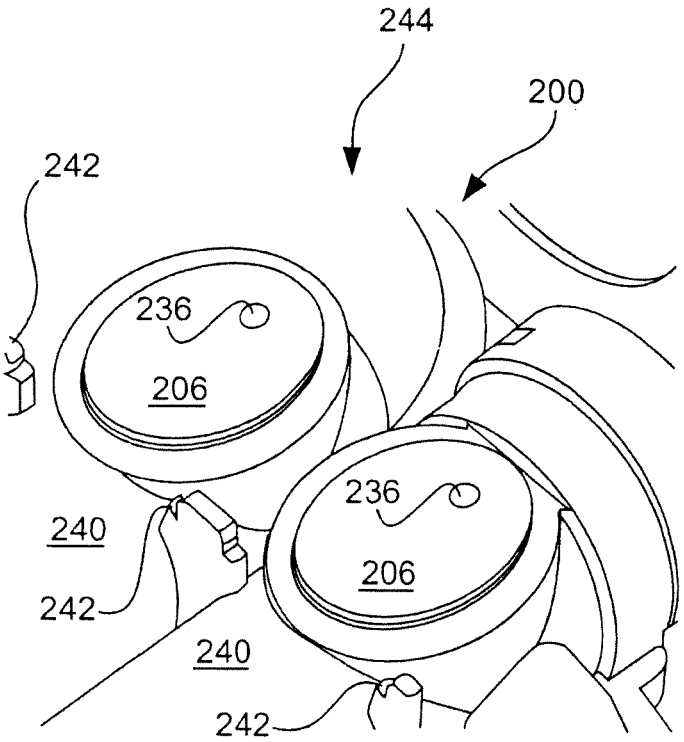
FIG. 2 schematically shows a detail of a heating block body in a perspective view of two closure pieces.
Figure 3:
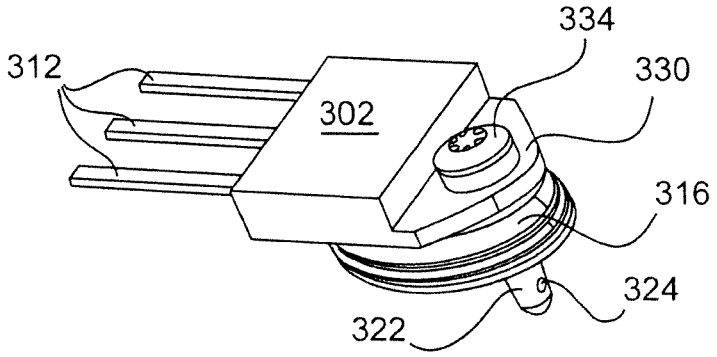
FIG. 3 shows a semiconductor switch with a closure piece in a perspective view.
Figure 4:
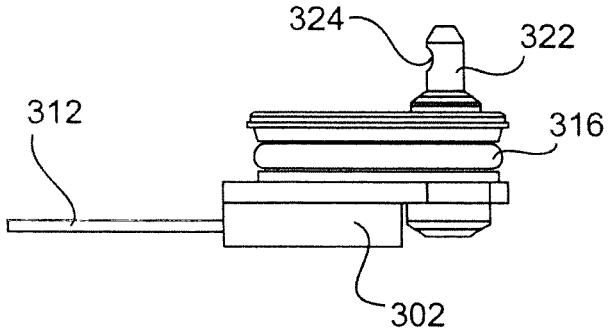
FIG. 4 shows the semiconductor switch with closure piece from FIG. 3 in a side view.
Figure 5:
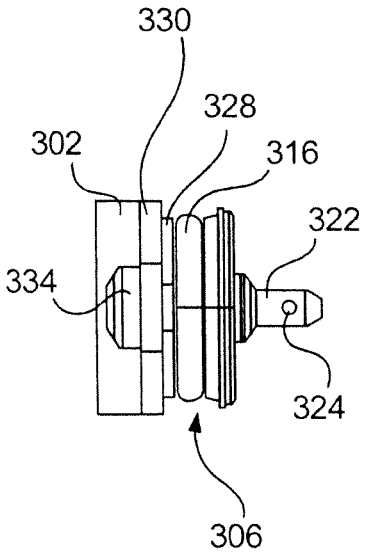
FIG. 5 shows the semiconductor switch with closure piece from FIGS. 3 and 4 in a front view.
Figure 6:
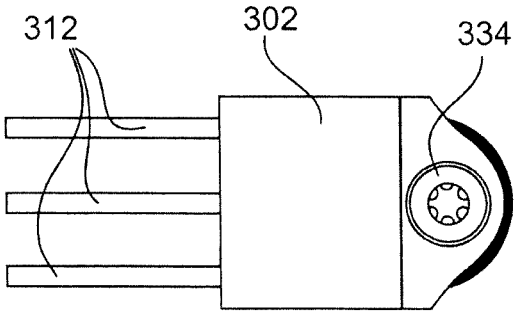
FIG. 6 shows the semiconductor switch with closure piece from FIGS. 3 to 5 in a top view.

FIG. 2 shows a detail of a heating block body 200 with two closure pieces 206 inserted into corresponding openings. Located in the heating block body 200 below each closure piece 206 is a heating conduit 240 shown only by an outward curvature in the heating block body 200. A heating element 18 which is connected to the respective closure piece 206 is inserted in each of these heating conduits.

Each of the two closure pieces 206 has a blind hole 236 with an internal thread so that a semiconductor switch can be placed on the closure piece 206 and screwed into this blind hole 236. A common board, i.e., a collective board for the heating block body 200, having the plurality of semiconductor switches can be provided for both closure pieces 206 and any further closure piece. The semiconductor switches can be arranged at the board in such a way that when the board is mounted at the heating block body 200 in an intended position a semiconductor switch is seated at a closure piece 206, particularly in such a way that the semiconductor switch can be screwed to the respective blind hole 236. The positioning means 242 shown in FIG. 2, which can also be referred to and formed as positioning projections or positioning pins, can be used to position a control board of this type. The heating block body 200 can be formed of two injection molded parts, for example, namely particularly an upper partial shell and a lower partial shell. FIG. 2 correspondingly shows an upper heating block body partial shell 244 which is fabricated as injection molded parts, and the positioning means 242 are formed in the injection mold and, correspondingly, integrally in this upper partial shell 244. Accordingly, when a control board is neatly positioned by these positioning means 242, the semiconductor switches fastened thereto are also correctly placed at the position for connecting to the respective closure piece 206.

FIGS. 3 to 6 show four different views of a semiconductor switch 102 which is fastened to a closure piece 306 by means of a fastening screw 343. Depending upon the view, it can be seen that the semiconductor switch 302 sits directly on a cover layer 328 with a fastening tab 330. To this end, the fastening screw 334 is screwed through the fastening tab 330 into a blind hole of the closure piece 306. The fastening screw 334 is approximately aligned with a heating coil fastening pin 322. The heating coil fastening pin 322 has a bore hole 324 as connection means for connecting a heating element, particularly a heating wire.

A sealing ring 316 is provided for sealing the inserts. Further, the semiconductor switch 302 has three connections 312 which can be used for actuating and for supplying with supply current.

Therefore, a solution is proposed which does away with the previous cooling zones which were coupled directly with the control electronics. Cooling subassemblies of this kind were very cost-intensive and also necessitated costly devices for handling in electronics manufacture. A solution is now suggested in which semiconductor switches, particularly triacs, namely triacs such as semiconductor switch 2 in FIG. 1 or semiconductor switch 302 in FIGS. 3 to 6, can be connected in a more economical way than heretofore.

In the suggested solution, cooling surfaces such as the lower contact surface 10 in FIG. 1 inter alia are also coupled with heating coil fastening pins such as heating coil fastening pins 22 and 322. This coupling also advantageously includes the use of fastening screws 34 according to FIG. 1 and fastening screws 344 from FIGS. 3 to 6 which achieve a direct fastening of the semiconductor switches or triacs and which also produces a good thermal connection with potential for cooling. A thermal connection is also formed via the fastening screws 34 and 334.

In this case, the semiconductor switches or triacs contact the heating coil fastening pin and also the fastening screw in the manner of an electrically conductive unit so that additional connections, particularly connection cables or cords from the triac to the heating body pin and fastening screw, are dispensed with.

Accordingly, it is suggested that the triacs be constructed as non-insulated component parts. The triacs are arranged on the electronics board or control board in such a way that, when assembled, they are seated directly over the heating conduits, e.g., heating conduits 240. In so doing, the heating body pins are spatially arranged in such a way that they lie directly below the triacs.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

The invention claimed is:

1. A heating block for heating a liquid medium, comprising:

a heating block body with a cavity for receiving or guiding the medium;

an electric heating element arranged in the cavity, and configured to heat the medium by means of electric current passing through the heating element;

a semiconductor switch configured to control the electric current flowing through the heating element so as to control a heating power of the heating element; and a closure piece configured to close an opening in the heating block body to the cavity element; and a heating coil fastening pin which electrically connects the semiconductor switch to the heating element;

wherein the semiconductor switch is electrically and thermally conductively connected to the closure piece by a first connection terminal, such that an electrical connection of the first connection terminal to the heating element is carried out via the closure piece and a thermal connection of the first connection terminal to the medium is carried out via the closure piece; and wherein the semiconductor switch is directly connected to a control board by a second connection terminal so that the semiconductor switch is spatially arranged and mechanically connected directly between the control board and the connection piece, and wherein the heating coil fastening pin thermally connects the semiconductor switch and the medium so that the semiconductor switch is cooled through the medium via the heating coil fastening pin.

2. The heating block according to claim 1;

wherein the control board is mechanically connected to the closure piece via the semiconductor switch.

3. The heating block according to claim 1;

wherein the semiconductor switch is arranged between the control board, or a portion thereof, and the closure piece to form a sandwich structure.

4. The heating block according to claim 1;

wherein the closure piece is configured to be in direct electrical contact with the medium.

5. A Continuous-flow heater comprising:

a heating block according to claim 1.

6. The heating block according to claim 1;

wherein the closure piece has an outer rim, and is inserted into the opening of the heating block body from an inner side proceeding from the cavity of the heating block body so that the outer rim is placed at the opening.

7. A heating block for heating a liquid medium, comprising:

a heating block body with a cavity for receiving or guiding the medium;

an electric heating element arranged in the cavity, and configured to heat the medium by means of electric current passing through the heating element;

a semiconductor switch configured to control the electric current flowing through the heating element so as to control a heating power of the heating element;

a closure piece configured to close an opening in the heating block body to the cavity element;

a heating coil fastening pin which is integrated in the closure piece, and which comprises:

a connection means, at a side facing the medium, configured to electrically connect the heating element; and a receptacle, at a side remote of the medium, configured to receive a fastening means which fastens the semiconductor switch to the heating coil fastening pin, wherein the semiconductor switch is electrically and thermally conductively connected to the closure piece by a first connection terminal, such that an electrical connection of the first connection terminal to the heating element is carried out via the closure piece and a thermal connection of the first connection terminal to the medium is carried out via the closure piece; and wherein the semiconductor switch is directly connected to a control board by a second connection terminal so that the semiconductor switch is spatially arranged and mechanically connected directly between the control board and the connection piece.

8. The heating block according to claim 7;

wherein the heating coil fastening pin and the closure piece are substantially formed as a one-piece metal body with a seal.

9. The heating block according to claim 7;

wherein the receptacle is formed as a blind bore hole with internal thread; and wherein the fastening means is provided with an external thread to screw the fastening means into the receptacle.

10. A heating apparatus comprising:

a semiconductor switch configured to control the current flowing through a heating element so as to control a heating power of the heating element;

a closure piece configured to close an opening in a heating block body; and a control board; and a heating coil fastening pin which electrically connects the semiconductor switch to the heating element, wherein the semiconductor switch is electrically and thermally conductively connected to the closure piece by a first connection terminal, such that an electrical connection of the first connection terminal to the heating element is carried out via the closure piece and a thermal connection of the first connection terminal to a medium to be heated is carried out via the closure piece;

wherein the semiconductor switch is directly connected to the control board by a second connection terminal so that the semiconductor switch is spatially arranged and mechanically connected directly between the control board and the connection piece, wherein the heating coil fastening pin thermally connects the semiconductor switch and the medium so that the semiconductor switch is cooled through the medium via the heating coil fastening pin.

* * * * *